US005383502A

United States Patent [19]

Fisk et al.

[11] Patent Number: 5,383,502

[45] Date of Patent: Jan. 24, 1995

[54] AUTOMATIC TONER DISPENSER LID LATCHING AND UNLATCHING SYSTEM

[75] Inventors: Duane H. Fisk, Whitesville; David B. Playfair, Rochester, both of N.Y.

[73] Assignee: Xerox Corporation, Stamford, Conn.

[21] Appl. No.: 161,297

[22] Filed: Dec. 3, 1993

[51] Int. Cl.[6] ..... G03G 15/06

[52] U.S. Cl. ..... 141/364; 222/DIG. 1; 355/260

[58] Field of Search ..... 222/325, DIG. 1, 160, 222/162, 561; 141/320, 363, 364; 355/260

[56] References Cited

U.S. PATENT DOCUMENTS

| | | | |
|---|---|---|---|
| 4,062,385 | 12/1977 | Katusha | 141/89 |
| 4,611,730 | 9/1986 | Ikesue | 222/167 |
| 4,997,016 | 3/1991 | Hacknauer | 141/363 |
| 5,074,344 | 12/1991 | Vacek | 141/363 |
| 5,089,854 | 2/1992 | Kaieda | 222/DIG. 1 X |
| 5,091,750 | 2/1992 | Yoshida et al. | 355/260 |
| 5,150,807 | 9/1992 | Seyfried et al. | 222/DIG. 1 X |
| 5,175,588 | 12/1992 | Katagata | 141/364 X |

OTHER PUBLICATIONS

Xerox Disclosure Journal, vol. 18, No. 5 Sep./Oct. 1993, p. 477 "Keyed Toner Bottle Cap and Hopper Fill Cap" author: Brendan W. Kunzmann.

*Primary Examiner*—Kevin P. Shaver

[57] ABSTRACT

An imaging material replenishment system for a reproduction apparatus, with an imaging material container removably insertable into an insertion guide, which container has a containment lid automatically removed upon insertion, with a lid latching member with a latching notch normally latching the containment lid to the container. The insertion guide has a latch engaging member such as a fixed pin positioned to engage an unlatching ramp surface of the lid latching member as the container is inserted, a locking slot returning the pin therein during dispensing, and thus holding the lid there, and another, oppositely inclined, ramp surface automatically relatching the lid to the container as the container is removed after dispensing. An integrated contents encoding and interlock system is also provided.

4 Claims, 6 Drawing Sheets

FIG. 2
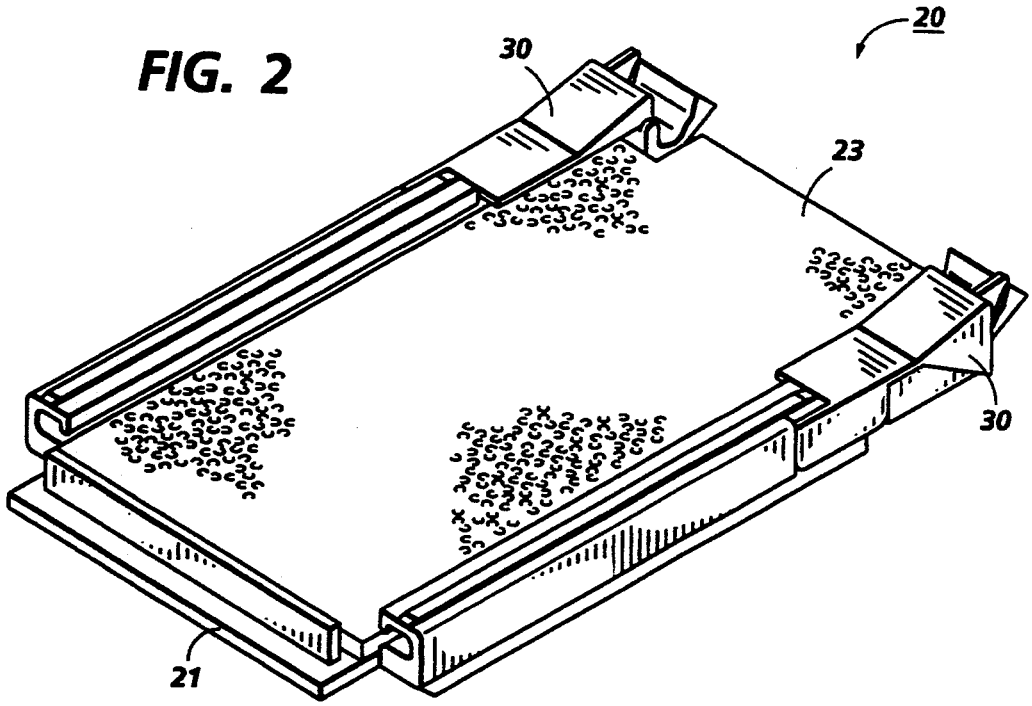
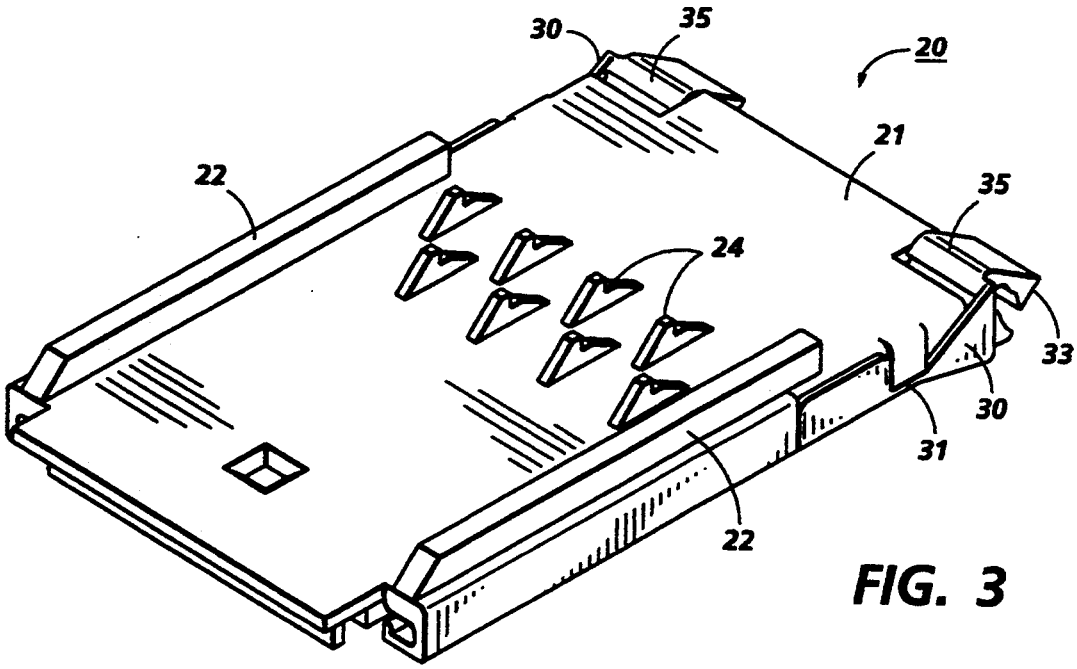
FIG. 3

AUTOMATIC TONER DISPENSER LID LATCHING AND UNLATCHING SYSTEM

The disclosed system provides for improved imaging material replenishment of a reproduction apparatus.

There is disclosed in the embodiment herein an improved means for the replenishment of the toner powder utilized in xerographic printers or copiers by the insertion of a toner container with an automatically removable and replaceable lid wherein an improved lid retention and removal system is provided.

In particular, there is disclosed an improved automatic lid locking and unlocking member automatically activated upon the insertion and removal of a lidded toner container into the insertion guide member for the reproduction apparatus.

Also disclosed is an associated lid encoding or key system for indicating the particular color or other property of the reproduction material in the container being inserted and automatically preventing material of the wrong property from being inserted into the insertion guide member for the reproduction apparatus.

The disclosed embodiment provides for a lower toner container insertion force yet improved retention of the toner container lid, without sacrificing the existing advantages of a desired "clean hands" or "white glove" toner replenishment system.

Of particular background interest as to toner dispensers of the type illustrated in the exemplary embodiment hereinbelow is Eastman Kodak Co. U.S. Pat. No. 4,062,385 issued Dec. 13, 1977 to J. M. Katusha, et al., and art cited therein, and any latter patents which may cite said 4,062,385.

An example of a reproduction apparatus and its developer units into which the exemplary reproduction material containers may be removably mounted, as in the Xerox Corporation "4850" or "4890" printers, is disclosed in Xerox Corporation U.S. Pat. No. 5,144,369 issued Sep. 1, 1992 (D/91517).

Noted re physically encoded or insertion restriction toner dispensing systems is the Xerox Disclosure Journal publication Vol. 18, No. 5 p. 477, September/October, 1993, by B. W. Kunzmann entitled "Keyed Toner Bottle Cap and Hopper Fill Cap." Also noted re this subject is Ricoh U.S. Pat. No. 4,611,730 to M. Ikesu, et al., (see especially FIG. 10).

A specific feature of the specific embodiment(s) disclosed herein is to provide in an imaging material replenishment system for providing imaging material for a reproduction apparatus, wherein the imaging material is provided in an imaging material container, and wherein said imaging material container is removably insertable into an insertion guide for a reproduction apparatus, and wherein said imaging material container has a containment lid which is automatically at least partially removed from said imaging material container upon the insertion of said imaging material container into said insertion guide to allow removal of imaging material from said imaging material container; the improvement wherein: said containment lid has a lid latching member normally latching said containment lid to said imaging material container in a material containment position; and said insertion guide includes a latch engaging member positioned to engage said lid latching member as said imaging material container is inserted into said insertion guide to unlatch said containment lid from said imaging material container so that said containment lid is removed from said imaging material container and held by said insertion guide until said imaging material container is removed from said insertion guide, whereupon said containment lid is automatically repositioned and re-latched by said latch engaging member in said material containment position of said imaging material container.

Further specific features provided by the system disclosed herein, individually or in combination, include those wherein said lid latching member includes at least one ramp surface, and a latching notch normally latched to said imaging material container; and said insertion guide includes a camming element which cams up said ramp surface to disengage said latching notch of said lid latching member from said imaging material container; wherein said lid latching member includes a spring mounted pivotal arm having a locking slot for said camming element on a front surface, and having said lid latching notch on a rear surface, and having an upwardly inclined ramp surface operatively communicating with said locking slot to guide said camming element into said locking slot; wherein said camming element is a laterally projecting pin extending into the insertion path of said containment lid into said insertion guide; or wherein said containment lid has a pattern of plural individually removable keying members encodable in accordance With the contents of said imaging material container which keying members mate with a pattern of stop members projecting from said insertion guide.

As to specific hardware components of the subject apparatus, or alternatives therefor; it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of this embodiment thereof, including the drawing figures (approximately to scale) wherein:

FIG. 2 is a perspective view of the exemplary containment lid unit of FIG. 1 per se;

FIG. 3 is a bottom perspective view of the containment lid unit of FIG. 2;

Figure 1:
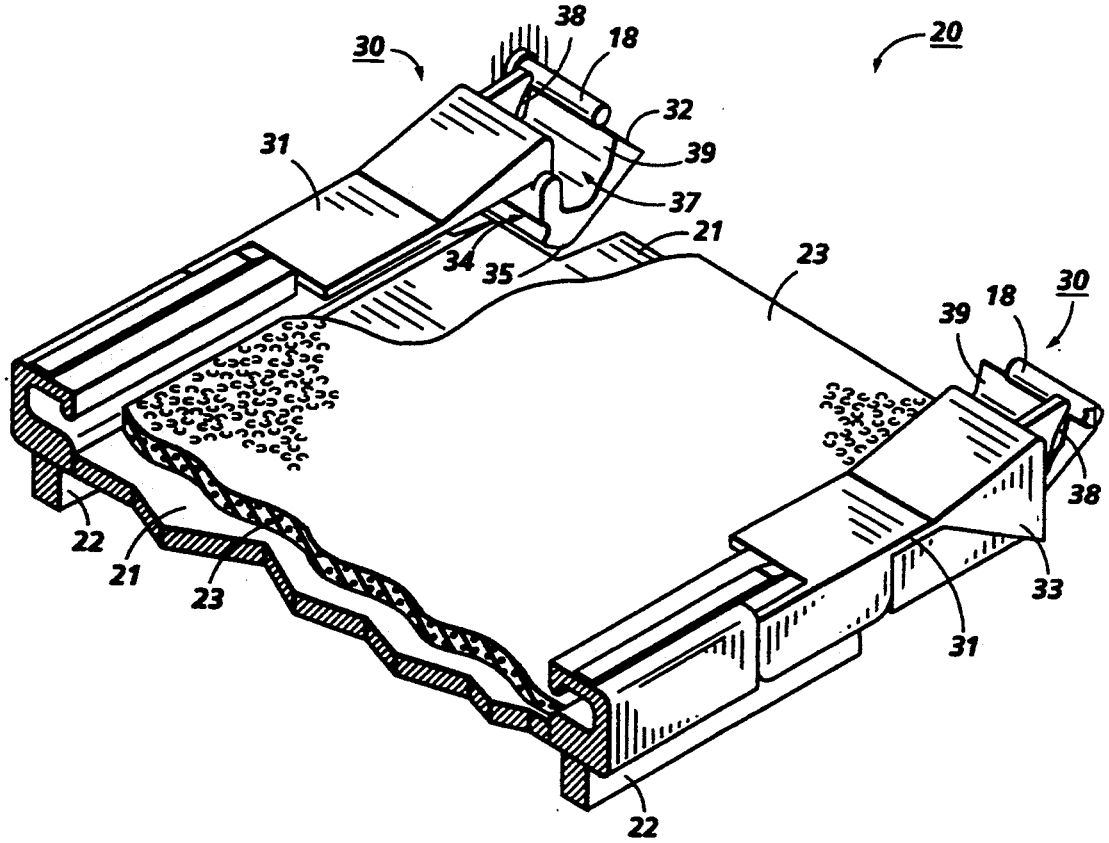
FIG. 1 is an enlarged partial perspective view of one embodiment of the subject imaging material dispensing system.

Describing now in further detail one exemplary embodiment 10 with reference to the Figures, this particular example of an imaging material replenishment system 10 is, of course, exemplary. Such a system may vary considerably depending upon the particular toner or other imaging material container 12 configuration, and the method or apparatus for container insertion and container opening in the particular xerographic copier, printer or other reproduction apparatus, which may vary widely. The example 10 illustrated here is that of and for the Xerox Corporation "4890" two color printer product announced Sep. 8, 1993.

The exemplary toner container 12 here has a flange 13 at its lowermost end extending laterally slightly outwardly from around the toner dispensing opening 14. This dispensing opening 14 is normally sealed closed by an automatically removable containment lid unit 20, to be described below. The entire unit comprising the toner container 12 and its containment lid unit 20 (secured and latched thereto), is inserted into the reproduction apparatus to dispense toner into the developer unit thereof. This is accomplished by inserting the toner container 12 with its integral lid unit 20 into an insertion guide member 16. The containment lid unit 20 slides into the insertion guide member 16 along side guide tracks or channels **16*a* thereof until the toner container 12 reaches a ramped up or raised surface 17 surrounding and defining a dispensing opening in the guide member 16 through which it is desired to dispense toner from the dispensing opening 14 in the toner container 12 into the reproduction machine. The toner container lid unit 20 is automatically removed from the toner container 12 to open its opening 14 as the toner container moves onto the raised surface 17** for dispensing.

The general function described above has been provided in previous systems, including the Xerox Corporation "4850" tri-level xerographic printer product launched in September, 1991. [See also the above-cited U.S. Pat. No. 4,062,385.] However, that previous "4850" toner container and lid unit had a spring loaded latch design which relied on the toner container bottle itself to raise the retaining springs or lid latching members at the point at which the lid was to be removed during its insertion. A drawback to that prior system had been in balancing the spring force retaining the lid latch so that it was efficient to normally retain the lid on the toner container, yet sufficiently weak to allow the unit to be slid into the seating or dispensing area using the forward movement of the toner container flange for lifting the lid retaining springs as the lid was removed.

The present system is an improvement thereover which can desirably utilize, essentially unchanged, many of the basic components of the previous system. In particular, the toner container 12 and the following portions of the containment lid unit 20: the main or plate portion 21, the integral side slide rails 22 adapted to slide into the side guide tracks **16*a* of the guide member 16, and the foam seal pad 23 on the plate 21 which normally seals the opening.14 until the containment lid unit 20** is removed automatically upon insertion.

In the improved system herein, new lid latching members 30 comprise two cantilevered moveable arm units 33, each of which may be spring arm mounted 31 to a respective side slide rail 22 of the lid unit 20. As may be seen, the operative end 33 of these latching members 30 are specially configured in unique shaped surfaces, as will be described. Each latching member 30 may be a single monolithic plastic molding. Although, as shown, the two latching members 30 are mirror images of one another and are not necessarily fully identical, since their operation is the same in this example, and they are identical as viewed from opposite sides here, they will be numbered and described here as if they were the same part.

In particular, the moveable arm end 33 of each latching member 30 has a leading inclined surface 32 and a latch lifting ramp surface 38 which is upwardly inclined to transition into a locking slot or recess 37. This arm end 33 also has a rounded bottom surface 35. The locking slot 37 also has associated therewith a downwardly inclined relatching surface 39. These surfaces 38 and 39 may be part of the locking slot 37, or one or both may be separate (laterally spaced) portions of the moveable arm end 33. As will be described, these ramp surfaces provide automatic unlatching and relatching of the two lid latching members 30 (and thus the connected lid unit 20) to the toner container 12.

For said lid latching, a latching notch 34 is provided in the rear surface of each moveable latch 30 arm end 33, above the bottom surface 35. This latching or locking notch 34 is designed to receive therein, and latch to, the projecting forward or leading edge of the flange 13 of the toner container 12. The spring mount 31 biases the latching member 34 down toward this latching position, but does not move it into or out of this latching position. In this latching position, the containment lid unit 20 is firmly secured to the toner container 12 so that toner cannot escape from the toner container 12 except during the final insertion movement of the toner .container 12 with said lid unit 20 in the insertion guide member 16.

An additional feature will now be described. It may be seen that the bottom of the plate 21 of the containment lid unit 20 here has two offset rows of spaced apart removable coding tabs 24. These tabs 24 are downwardly projecting small molded plastic stops here, which can be easily removed by grinding, breaking off laterally, or the like. These coding tabs 24 are designed to engage with insertion control or stops or code pins 19 (or tabs, dimples, upsets, etc.) projecting vertically up from the surface of the insertion guide member 16 in the area thereof where the toner container 12 first enters, or attempts to enter, the guide member 16. Thus, based upon the pattern of these control pins 19 that are preset on the insertion guide member 16, and the pattern of removed coding tabs 25, a "lock and key" arrangement is provided. This prevents insertion of any particular toner container 12 (with its locked-on containment lid unit 20) into the insertion guide member 16 unless the appropriate coding tabs 24 thereon have been removed to allow passage of the toner container unit past the particular pattern of control pins 19. This prevents insertion of a toner container 12 containing imaging material of the wrong color or other incorrect property into the wrong machine or developer unit. Here, this is provided in a simple manner, not requiring any electrical signals, and easily manufactured at low cost. A proper match or "lock and key" fit allows the container 12 to continue further into the guide member 14 to its unlatching and dispensing position. (Note the above-cited U.S. Pat. No. 4,611,730.)

Figure 4:
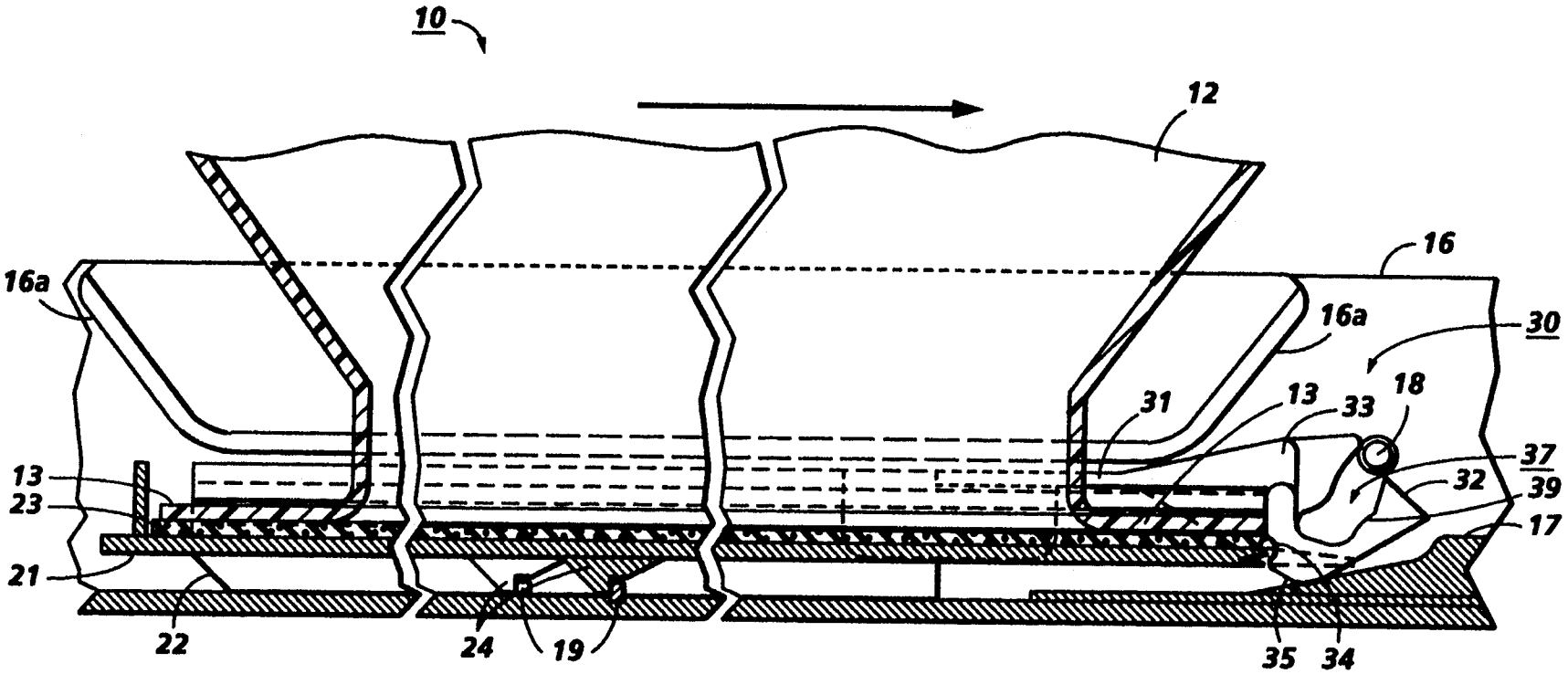
FIGS. 4–6 illustrate sequentially, in a partial side view, the lid unit removal and latching operation of the system of FIGS. 1–3.
Figure 5:
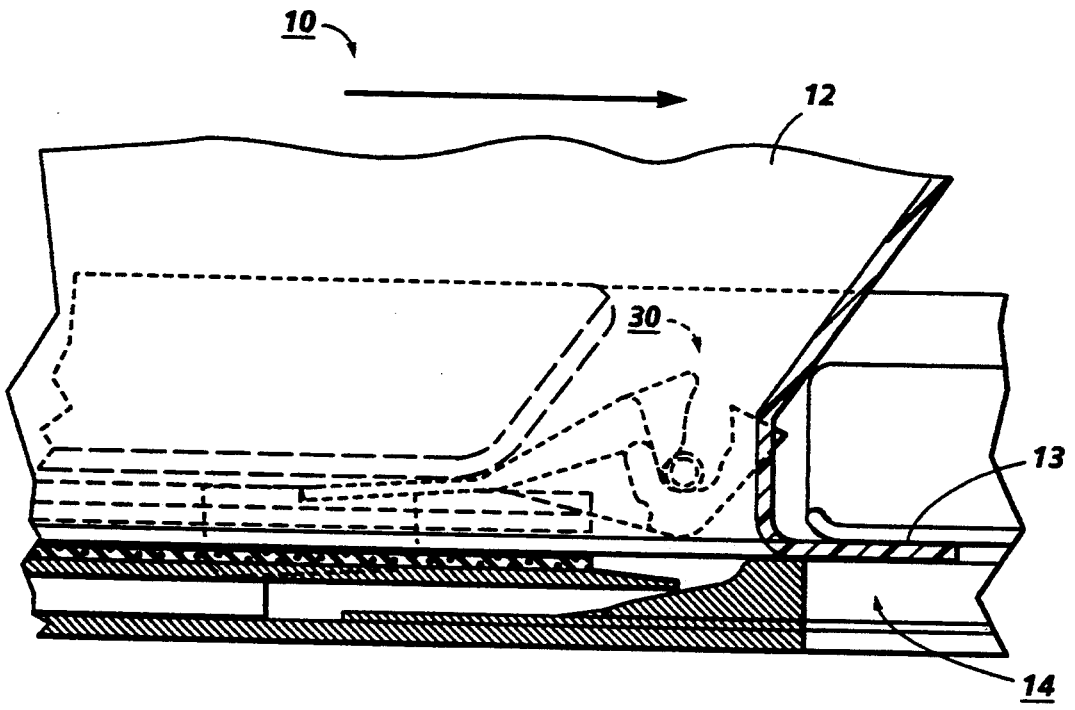
Figure 6:
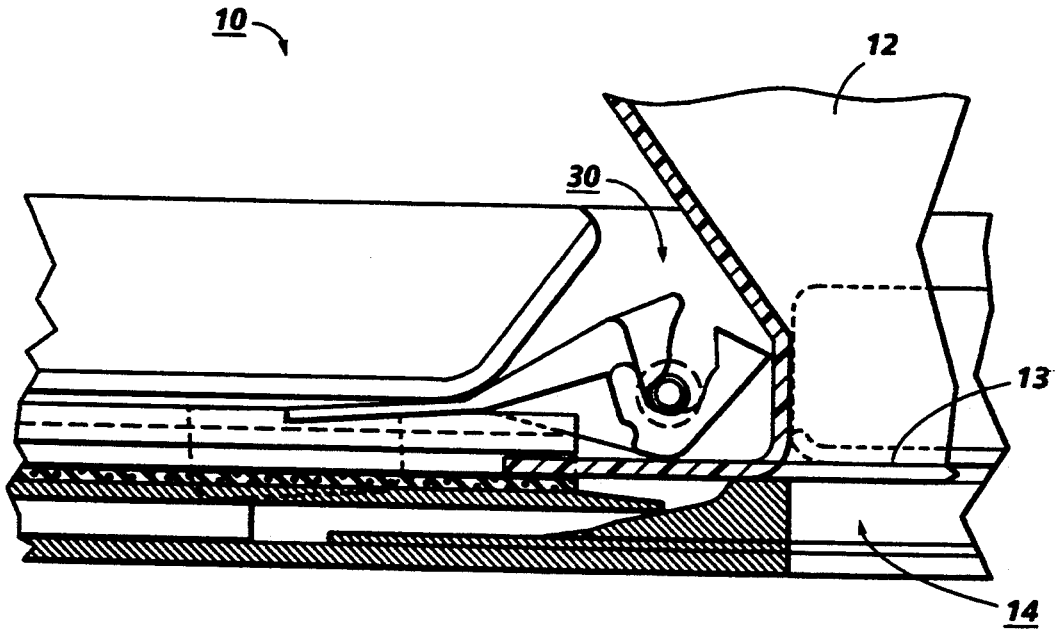
Figure 7:
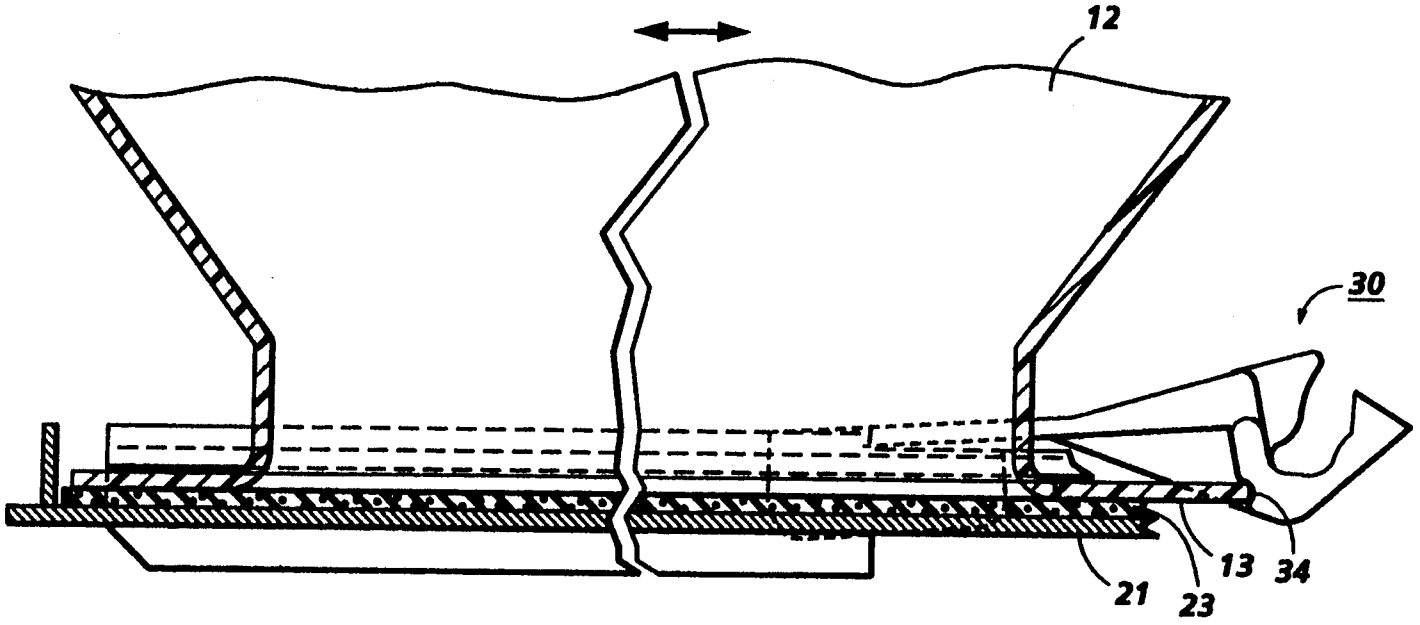
FIG. 7 shows the container and its latched-on lid unit removed from the reproduction apparatus.
Figure 8:
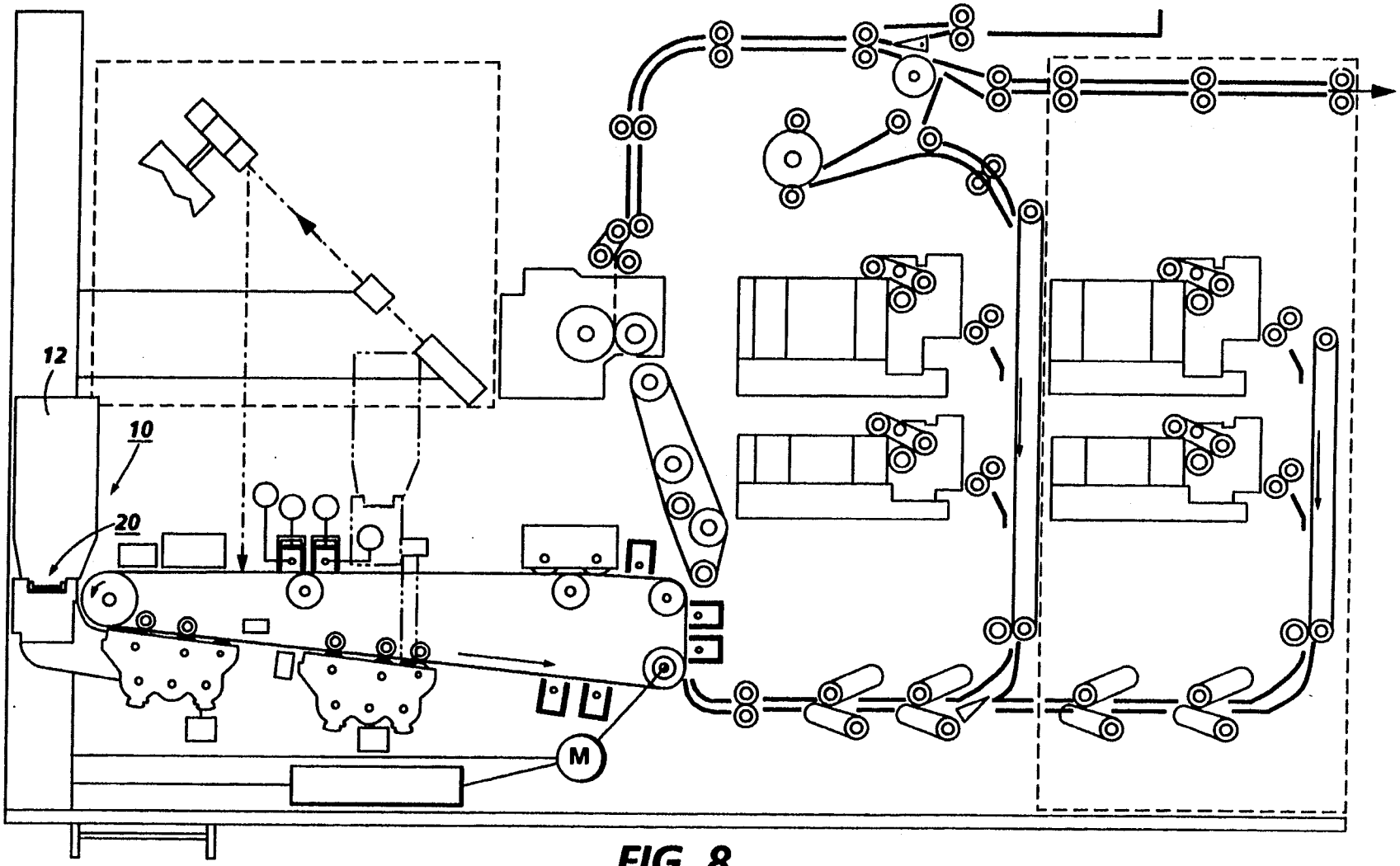
FIG. 8 is a frontal schematic view of an exemplary xerographic printer (known per se) showing one reproduction apparatus application of the system of FIGS. 1–7.

Referring now particularly to FIGS. 4–6, and to the automatic unlatching of the two lid latching members 30 to release the lid unit 20 during the final insertion of the toner container 12, it may be seen that here the insertion guide member 16 is provided with two unlatching/latching pins 18 projecting horizontally into the path of the lid unit 20 during its final insertion. These pins 18 are preferably located closely adjacent to the position of the surface 17, i.e. at the location where the forward (insertion) movement of the lid unit 20 is to be stopped so that the further container 12 movement down the guide member 16 will remove the lid unit 20 as the toner container 12 moves onto the raised surface 17 around the dispensing opening there.

To this end, the leading inclined surface 32 of the latching member 30 insures that each latching member moveable end 33 initially passes under the respective locking pin 18 by deflecting it slightly downwardly, as allowed by the spring arm 31 mounting of the latching member 30. As the forward (insertion) movement of the lid unit 20 continues, these fixed position pins 18 then engage a different, latch lifting, ramp surface 38. This ramp surface 38 is upwardly inclined, to lift or cam up the end 33 of the latching member 30. This pulls the latching notch 34 thereon up away from the toner container flange 13 to unlatch or unlock the lid unit 20 from the toner container 12, with relatively little insertion force. Furthermore, this ramp surface 38 guides the pivotal end 33 of the latching member 30 into engagement with the pin 18 by guiding the locking slot 37 thereof onto the pin 18.

Thus, as the toner container 12 per se continues to move forward to the end of the insertion guide member 16, the entire lid unit 20 remains securely retained within the insertion guide member 16 at the position defined by the locking pins 18, which are now respectively within the locking slots 37 of the now raised latching members 30.

It will be appreciated that an additional paper tape seal or the like may be provided for the dispensing opening 14 of the toner container 12, which is removed by being pulled out by the operator after the insertion of the toner container 12 fully into the insertion guide member 16. However, this is conventional and well known and need not be described herein. See, e.g., the above-cited U.S. Pat. No. 4,062,385.

Referring now to the subsequent time or event when the toner container 12 is to be removed from the insertion guide member 16, such as when all of the imaging material therein has been dispensed, the present system also provides low-force automatic relatching of the lid unit 20 latching members 30 to the toner container 12. This relatching is also accomplished by an inclined ramp on arm end 33, thus providing a smoother, more gradual, and better controlled relatching as compared to the previous design, and not requiring a spring force which could deform the bottle flange. That is, here the relatching is not required to be provided by a spring force, rather it is provided by the engagement of the locking pin 18 with the inclined relatching surface 39, which may be the bottom surface of the locking slot 37, as the toner container 12 is initially pulled back out of the insertion guide member 16 by the operator. The pin 18 thereby presses down the moveable arm end 33 of the latching member 30 until the locking notch 34 snaps over the end flange of the toner container 12, to relatch the lid unit 20 thereto. Thus, the toner container 12 is removed with the lid unit 20 firmly secured thereto fully automatically, with no operator interaction or thought required. (Note that, as in the prior device, the opposite end of the lid unit 20 plate 21 has a fixed raised stop preventing the other end of the flange 13 from moving in that direction.)

Thus, it may be seen that there is provided here, in a simple mechanism that may be manufactured at low cost from plastic molded components, a toner containment lid unit 20 which fully automatically unlocks upon insertion and fully automatically relocks upon removal, thereby automatically opening and closing the toner container 12 reliably and with low forces. Furthermore, the only modification of the insertion guide member 16 here is the addition of the locking pins 18, or other such simple projecting members such as a metal tab, stud, screwhead, or the like.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In an imaging material replenishment system for providing imaging material for a reproduction apparatus, wherein the imaging material is provided in an imaging material container, and wherein said imaging material container is removably insertable into an insertion guide for a reproduction apparatus, and wherein said imaging material container has a containment lid which is automatically at least partially removed from said imaging material container upon the insertion of said imaging material container into said insertion guide to allow removal of imaging material from said imaging material container; the improvement wherein:

said containment lid has a lid latching member normally latching said containment lid to said imaging material container in a material containment position to prevent removal of said containment lid; and said insertion guide includes a latch engaging member engaging and moving said lid latching member as said imaging material container is inserted into said insertion guide, said engagement unlatching said containment lid from said imaging material container so that upon further insertion of said imaging material container into said insertion guide said containment lid is removed from said imaging material container and held by said insertion guide until said imaging material container is removed from said insertion guide, said containment lid being automatically re-latched by said latch engaging member moving said lid latching member in said material containment position of said imaging material container upon removal of said imaging material container from said insertion guide, wherein said lid latching member includes at least one ramp surface engaging said latch engaging member, and a latching notch normally latched to said imaging material container; and said latch engaging member of said insertion guide cams up said ramp surface to disengage said latching notch of said lid latching member from said imaging material container.

2. The imaging material replenishment system of claim 1, wherein said lid latching member includes a spring mounted pivotal arm having a locking slot on a front surface, and having said lid latching notch on a rear surface, and said ramp surface is upwardly inclined and operatively communicating with said locking slot to guide said latch engaging member into said locking slot.

3. The imaging material replenishment system of claim 1 wherein said latch engaging member is a laterally projecting pin extending into the insertion path of said imaging material container into said insertion guide.

4. The imaging material replenishment system of claim 1, wherein said containment lid has a pattern of plural individually removable keying members encodable in accordance with the contents of said imaging material container which keying members mate with a pattern of stop members projecting from said insertion guide.

* * * * *